US005645128A

United States Patent [19]

Schwall

[11] Patent Number: 5,645,128

[45] Date of Patent: Jul. 8, 1997

[54] FIRE SAFETY GREASE SEAL

[76] Inventor: Charles F. Schwall, 321 Heritage Way, Algonac, Mich. 48001

[21] Appl. No.: 464,291

[22] Filed: Jun. 5, 1995

[51] Int. Cl.[6] ..... A62C 37/36

[52] U.S. Cl. ..... 169/42; 16/48.5

[58] Field of Search ..... 16/48.5; 431/21; 169/42; 122/504.1, 504.3; 126/287.5, 299 E

[56] References Cited

U.S. PATENT DOCUMENTS

| | | | |
|---|---|---|---|
| 1,446,554 | 2/1923 | Ellison | 169/42 |
| 3,469,569 | 9/1969 | Brockbank | 126/287.5 |
| 3,779,004 | 12/1973 | Gloeckler | 59/93 |
| 4,936,287 | 6/1990 | Hart et al. | 126/287.5 |
| 5,120,152 | 6/1992 | Gueli | 403/179 |

*Primary Examiner*—Carroll B. Dority

[57] ABSTRACT

The invention is a grease and dirt seal that is interposed in the connection between a flared tube and an adapter for engaging a support frame. The seal is circular with flat planar surfaces and a throughgoing aperture centrally positioned and adapted to allow a cable to move freely and without restriction. The seal is intended to prevent grease and dirt from entering the tube.

1 Claim, 2 Drawing Sheets

FIRE SAFETY GREASE SEAL

BACKGROUND OF THE INVENTION

1. Field of the invention

This invention relates generally to the suppression systems and more particularly to a grease and dirt seal that will insure positive operation of the system.

2. Description of the relevant prior art

There are many forms and types of fire suppression systems, each system is designed to perform under a specific set of conditions. As a general rule most systems have the are suppression material located at a distance from the area protected. Sensors for the system are located in the area to be protected as are the suppression material dispensers.

In order to provide fail safe systems the sensors are often spring biased cables that contain fusible links which melt or other wise deteriorate and weaken in the presence of predetermined elevated temperatures. When the link or links separate the cable moves through tubing, which acts as a protective housing, and activates the fire suppression system.

The situation which occurs and is resolved by this invention is when the sensors are used in an area where there is an atmosphere with a high content of grease, dirt or paint in aerosol form. The situation typically arises over the deep fry cookers in commercial restaurants and in the spray booths of commercial paint shops. The air, drawn by evacuating blowers tends to have a uneven turbulent flow and as a result some of the particles are thrown aside and land on the walls of the range hood or paint spray booth for example. After a period of time, experience shows that a sufficient number of those particles could collect in the protective housing of the cable to inhibit the safe and quick operation of the fire suppression.

This invention adds a grease and dirt seal to the entrance of the tubing where the cable enters and exits within the contaminated atmosphere where the collection of particles is most likely to occur.

Examples of mechanical fusible links are shown in U.S. Pat. Nos. 3,779,004 issued Dec. 18, 1973 to Gloeckler who uses the link with a chain for controlling a weight release for a door closing or sprinkler system where two link elements are held against movement by a fusible temperature responsive retainer. U.S. Pat. No. 4,936,287 issued Jun. 26, 1990 to Hart et al. discloses a fusible link used with a ventilation system in a ceiling air diffuser were the fusible link would melt and close the butterfly valve and close off the supply of air to the room. U.S. Pat. No. 5,120,152 issued Jun. 9, 1992 to Gueli for a fusible link which consists of a pair of overlying plates adapted to engage a cable or other suitable device which are connected by a eutectic alloy selected to melt at a selected temperature and allow the plates to separate thereby allowing the connected system to function as designed.

The references taken alone or in combination or combined with what is common and well known to those skilled in the art fail to anticipate the invention disclosed and claimed herein.

SUMMARY OF THE INVENTION

The invention is characterized by a generally circular grease and dirt seal that is added to the connection between the tubular housing for a detector cable in a fire suppression system and the open frame that supports the housing and between whose arms the fusible link is suspended. Typically the tubing which contains the run of stainless steel cable is common electrical conduit. Since such conduit is routinely cut to length, it is not threaded at the end and instead a connector or adapter is used for that purpose. The adapter is threaded on each side of an abutting surface which contains flats for engagement by a wrench. One end of the adapter is passed through the opening in an electrical box or in this case the support frame. A nut is applied to the adapter and it is secure in place. The tubing is cut to length and a nut having a shoulder is slipped over the tubing and the end of the tubing is flared in a manner well known in the art. The nut is then brought into engagement with the adapter and the tubing is then secured to the electrical box or frame. This invention includes a grease and dirt seal between the adapter and the tubing to prevent contaminants from collecting and building up within the tube and either slowing or stopping the cable from moving in the event of an emergency when the fusible link melts or is otherwise activated.

It is therefore an object of the invention to provide a new and improved fire safety grease and dirt seal.

It is another object of the invention to provide a new and improved fire safety grease seal that fit into new and existing fire suppression systems without modification of those systems.

It is a further object of the invention to provide a new and improved fire safety grease and dirt seal that is simple and effective to use.

It is still another object of the invention to provide a new and improved fire safety grease and dirt seal that is low in cost.

It is still a further object of the invention to provide a new and improved fire safety grease and dirt seal that has no moving parts and requires no special tools for installation.

It is another object of the invention to provide a new and improved fire safety grease and dirt seal that has a high degree of reliability.

These, together with other objects of the invention, along with the various features of novelty which characterize the invention, are pointed out with particularity in the claims annexed to and forming a part of this disclosure. For a better understanding of the invention, its operating advantages and the specific object attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
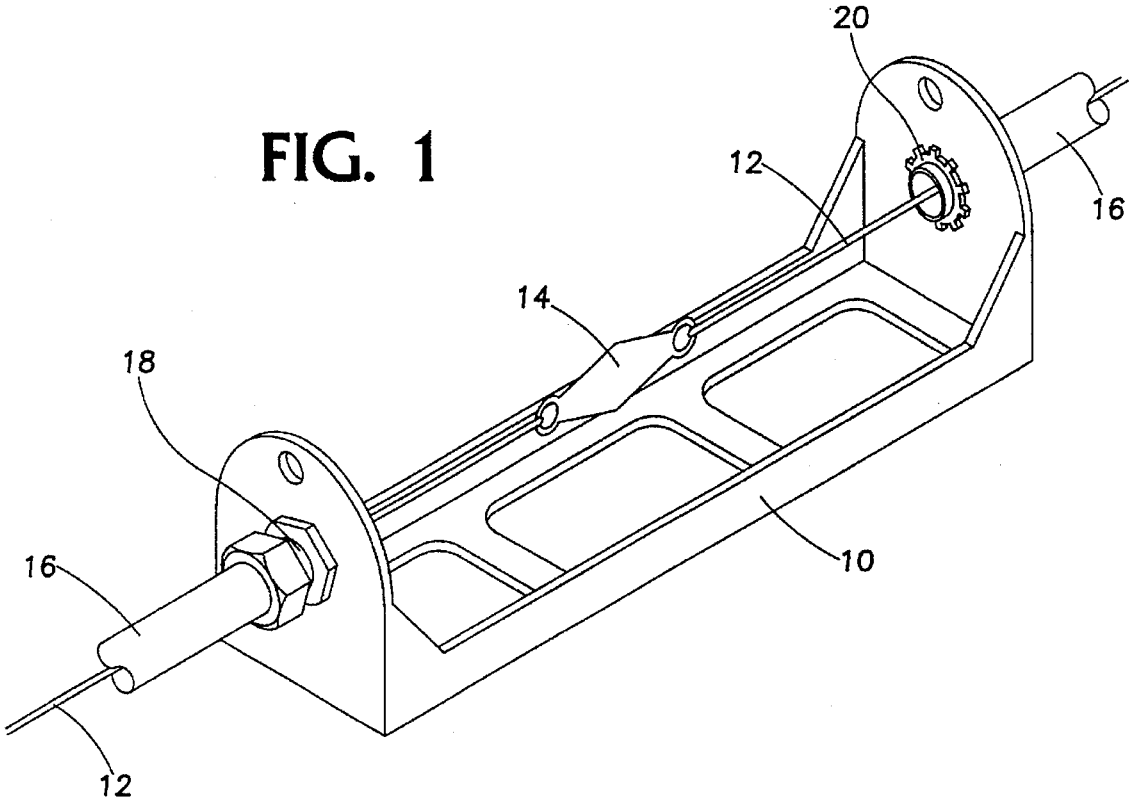
FIG. 1 is an environmental view showing one application of the invention.

Referring now to FIG. 1 a support frame is shown at 10. The frame would ordinarily be attached to a wall or other firm support surface. In the case of a system with more than one fusible link the stainless steel cable 12 connects to the fusible link 14 and passes on to the next location. The cable is protected by a tube 16 which engages an adapter 18 which is secured to the housing by a nut 20. The metal seal of the invention lies between the adapter 18 and the tubing 16.

Figure 2:
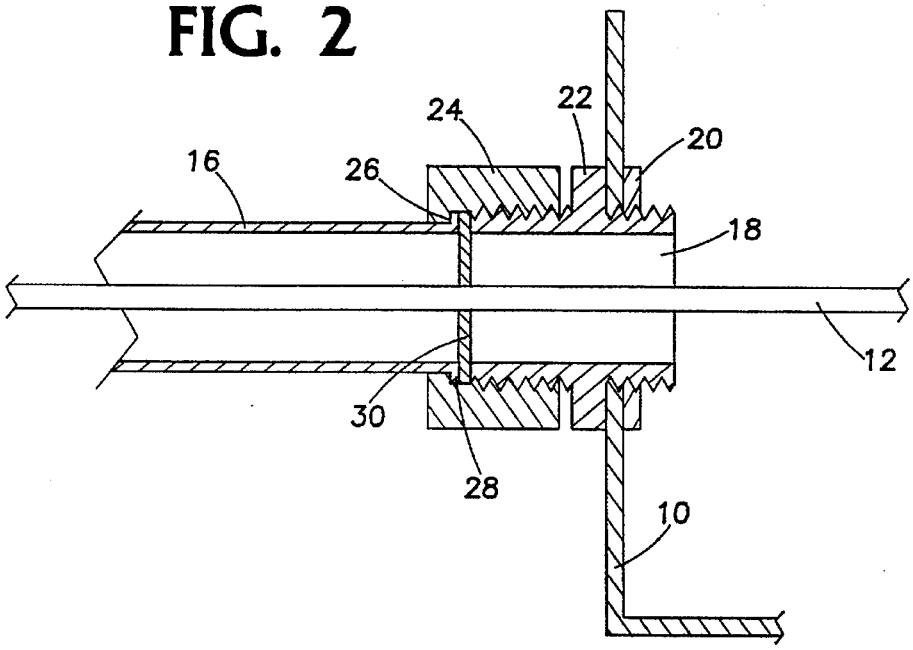
FIG. 2 shows a cross sectional view of the invention installed.
Figure 3:
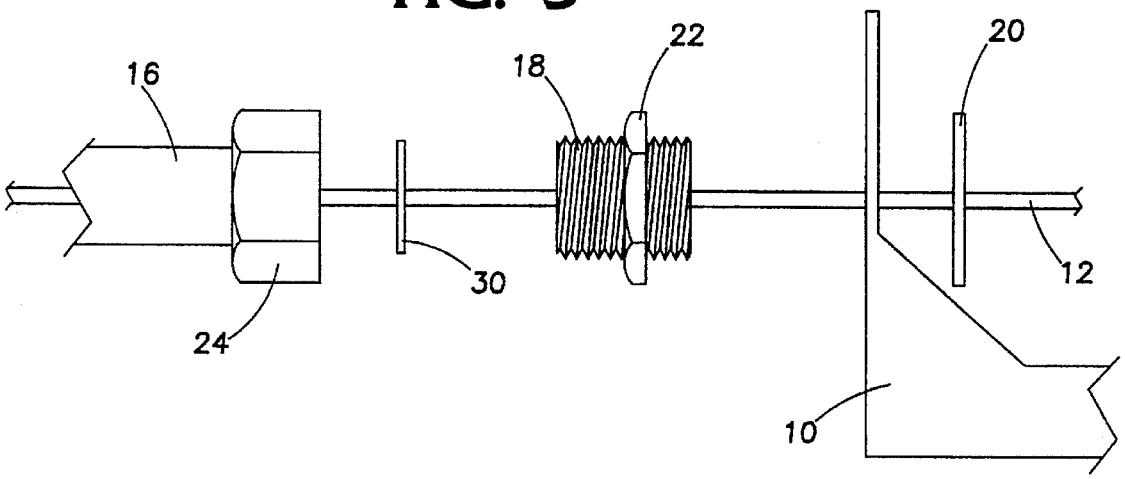
FIG. 3 is an exploded view of a connection including the seal of the invention.

FIGS. 2 and 3 detail the location of the seal within the connection. One end of the adapter 18 passes through the wall of the frame 10 and is secured in place by the nut 20 which draws the butt face 22 against the opposed wall of the frame 10. Tube nut 24 includes a shoulder 26 which engages the flare 28 at the end of the tube 16 and when threaded on the adapter 18 forms a firm connection between the tube and the frame 10. The grease and dirt seal is installed between the flare 28 and the cooperation surface of the adapter 18. The seal contains a central aperture that allows the cable to pass through in an unobstructed manner.

Figure 4:
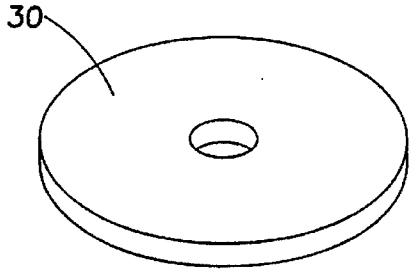
FIG. 4 is a perspective view of the invention.

The seal is shown in FIG. 4 and consists of a circular metal piece having a planar surface with a central aperture. The dimensions of the seal are sufficient in all aspects to provide a clearance fit for the cable and the adapter.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. In a fire sensing and detecting system including a frame, a cylindrically shaped adapter having a throughgoing aperture and external threads, a ridge forming a butting surface surrounding the aperture at the midpoint between the ends, extending through an aperture in a wall of the frame and secured by the butting surface engaging the wall on one side and a nut threaded on the adapter from the opposed side and engaging the wall; a tube; a cable passing through the tube and connected at one end, proximate the frame, to a fusible link; a tube nut threadedly engaging the adapter and connecting the tube to the adapter, the improvement comprising: a grease seal interposed between the tubing and the adapter comprising a circular member having planar surfaces and a through going aperture centrally positioned therein and adapted to allow the cable to pass through without interference.

* * * * *